US005339762A

United States Patent [19]

Waclawik et al.

[11] Patent Number: 5,339,762

[45] Date of Patent: Aug. 23, 1994

[54] UNDERSEA LAUNCHER FOR A TETHERED DEVICE

[75] Inventors: Ronald E. Waclawik, Fairhaven, Mass.; George M. Duarte, Bristol; Louis P. Dinola, Cranston, both of R.I.

[73] Assignee: The United States of America as represented by the Secretary of the Navy, Washington, D.C.

[21] Appl. No.: 79,766

[22] Filed: Jun. 21, 1993

[51] Int. Cl.[5] ..... B63G 8/00

[52] U.S. Cl. ..... 114/312

[58] Field of Search ..... 114/312, 313, 316–329, 114/336, 244, 245, 253, 254, 242

[56] References Cited

U.S. PATENT DOCUMENTS

| | | | |
|---|---|---|---|
| 997,713 | 7/1911 | Spear | 114/317 |
| 3,245,373 | 4/1966 | Sibold, Jr. | 114/244 |
| 3,722,452 | 3/1973 | Wynn, Jr. | 114/244 |
| 3,961,589 | 6/1976 | Lombardi | 114/244 |
| 4,185,345 | 1/1980 | Waclawik et al. | 114/318 |

*Primary Examiner*—Edwin L. Swinehart

*Attorney, Agent, or Firm*—Michael J. McGowan; Prithvi C. Lall; James M. Kasischke

[57] ABSTRACT

An apparatus for ejecting a tethered underwater device, such as a communications instrument package, from a naval vessel such a submarine is taught. The system incorporates a relatively long hydraulically operated launch tube thereby permitting slow acceleration of the device to achieve the desired muzzle velocity resulting in a reduced acoustic pressure wave upon launch.

14 Claims, 3 Drawing Sheets

UNDERSEA LAUNCHER FOR A TETHERED DEVICE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to an apparatus for ejecting, underwater, an object from a naval vessel and more particularly launching a tethered object from a submerged submarine.

In typical submarine underwater communication systems wherein the seawater is used as the medium through which communication signals are transmitted, it is desirable to position a communications transmitting package at some distance from the vessel. Generally the communication package utilizes a tether line comprising electric or fiber optic transmission means therein thereby forming a hard communication link between the communication package and the vessel. Many times the communication package is towed at some distance behind the vessel. In these instances the tether line not only provides a communications link with the vessel but also acts as a tow cable and must necessarily be prevented from becoming entangled in the vessel's propellers or other external appendages during normal maneuvers. This is particularly troublesome in submarine operations.

Further, as is easily understood, particularly for submarine type vessels, it is most desirable that the launch of such communication devices be accomplished without creating significant acoustic pressure impulses.

(2) Description of the Prior Art

Heretofore, in submarine operations, it has been known to mount a non-reloadable, one shot type launcher mechanism outside of the ship's pressure hull and far enough aft to allow clearance of the ship's structure by the ejected instrument package. This approach is undesirable as it requires an added appendage to the otherwise carefully configured hydrodynamic shape of the submarine and will most likely introduce hydrodynamic turbulence during normal cruising of the vessel thereby creating an acoustic pressure disturbance. Further, such a one shot system would necessarily be reloadable only when operating above the surface or when in port; therefore, multiple launchers would be necessary compounding the hydrodynamic noise problem. Such one shot systems are obviously impractical in view of the long duration underwater voyages of which our nuclear submarines are capable.

Further such external appendages would necessarily incorporate short launch tubes requiring rapid acceleration of the ejected instrument package so as to obtain the escape velocities necessary to propel the instrument package the necessary distance from the ejecting vessel.

SUMMARY OF THE INVENTION

It is an object of the present invention to provide a system for the launch of a tethered instrument package from inside the pressure hull of a submarine.

It is a further object of the present invention to provide a tethered instrument package launch system that employs a long launch tube thereby permitting a slow acceleration and reduction of acoustic pressure impulses.

It is still a further object of the present invention to provide a tethered instrument package launch system that permits launch of the instrument package from a selected external vessel structural element thereby preventing entanglement of the tether line with the vessel's propellers.

These objects are accomplished by the present invention as disclosed and taught wherein the apparatus for the launch mechanism is contained within the submarine's pressure hull. Thus the present invention will easily accommodate repeated reloading of the system while the submarine is submerged. Further because of the system's operational dynamics, as will be further described below, the instrument package can be launched with relatively slow acceleration thereby reducing the generated acoustic pressure impulse.

By the present invention a suitable launch tube is mounted within the vessel having the launch tube discharge end projecting through the vessel's pressure hull, thus a reload or breech mechanism can be placed within the vessel's pressure hull. The breech of the launch tube comprises an openable breech chamber for placement of the instrument package therein. The discharge port of a pump hydraulically communicates with the breech chamber to provide a flow of seawater, under pressure, thereto. The suction port of the pump hydraulically communicates with a seawater intake port extending through the pressure hull of the vessel to supply seawater to the pump upon demand. Positioned between the suction port of the pump and the seawater intake is an intake valve, to selectively interrupt the flow of seawater into the suction port of the pump. Thus a fluid path is provided from the seawater intake, through the intake valve and the pump into the system's breech chamber. A discharge valve, preferably a ball type valve, on the discharge side of the breech chamber prevents entry of seawater from the launch tube.

A secondary launch tube continues from the discharge end of the primary launch tube, external of the vessel's pressure hull, through the vessel's non-pressurized structure and exits at a location selected to prevent entanglement of the instrument package tether with the propeller or the vessel's structure.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
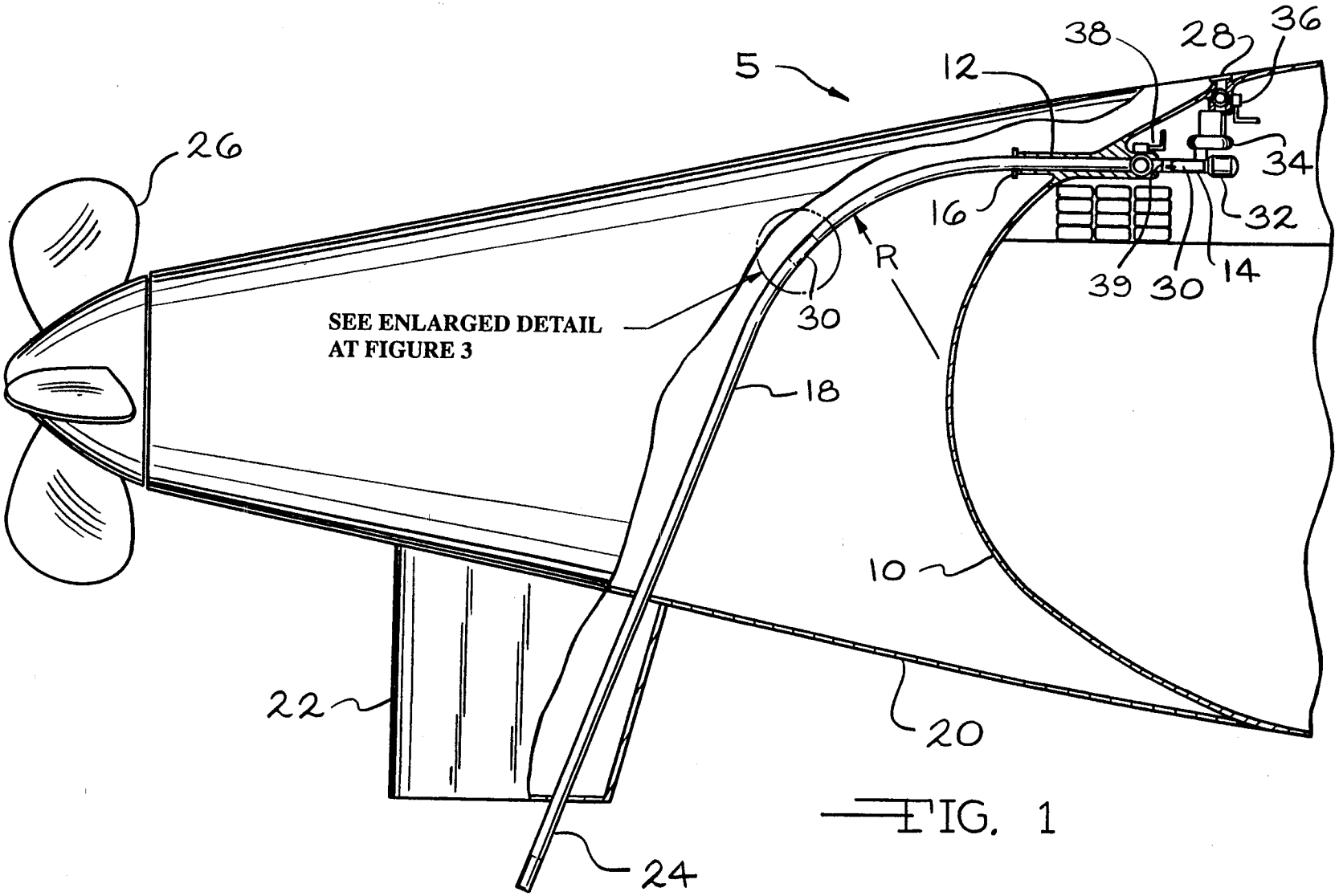
FIG. 1 schematically depicts the aft portion of a typical submarine type vessel incorporating the present invention.
Figure 2:
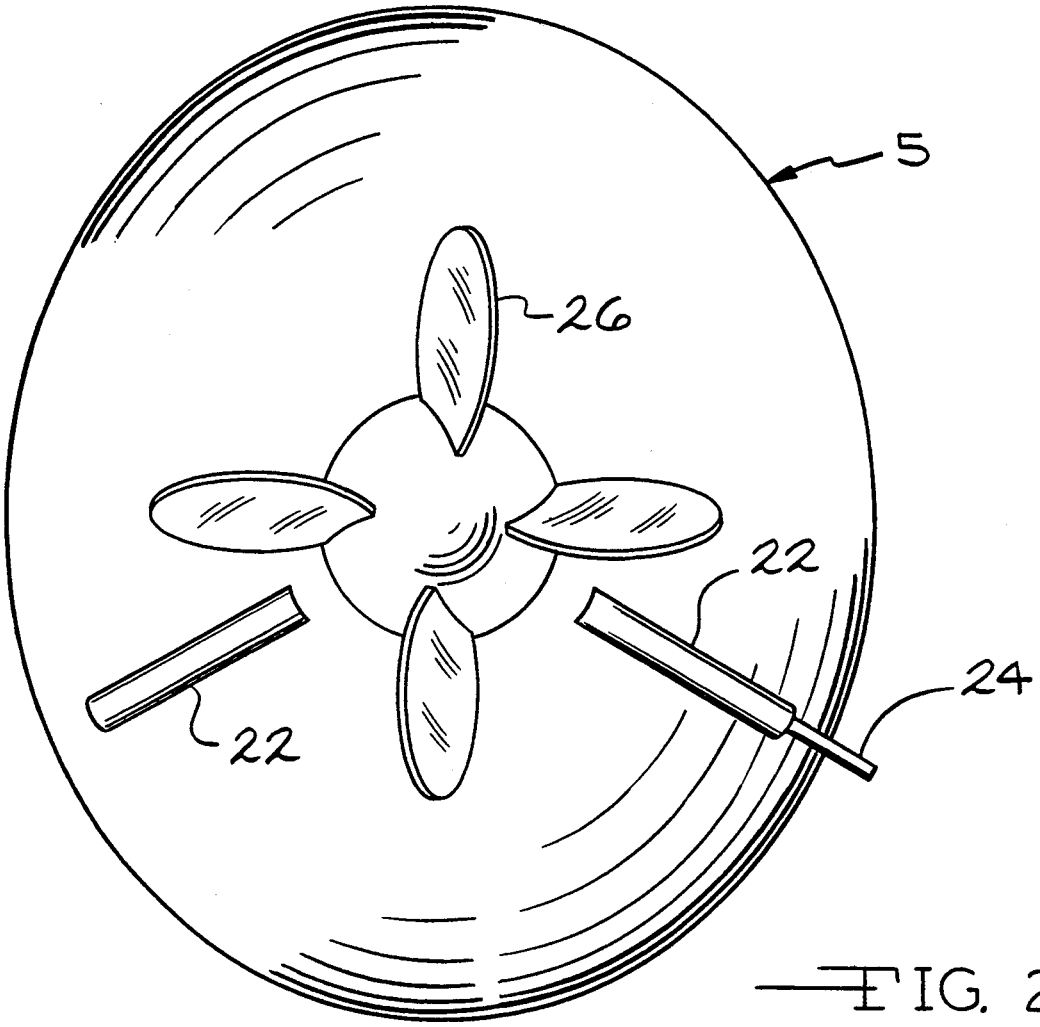
FIG. 2 depicts the rear elevational view of a typical modern submarine vessel wherein the launch tube is directed radially away from the vessel.
Figure 4:
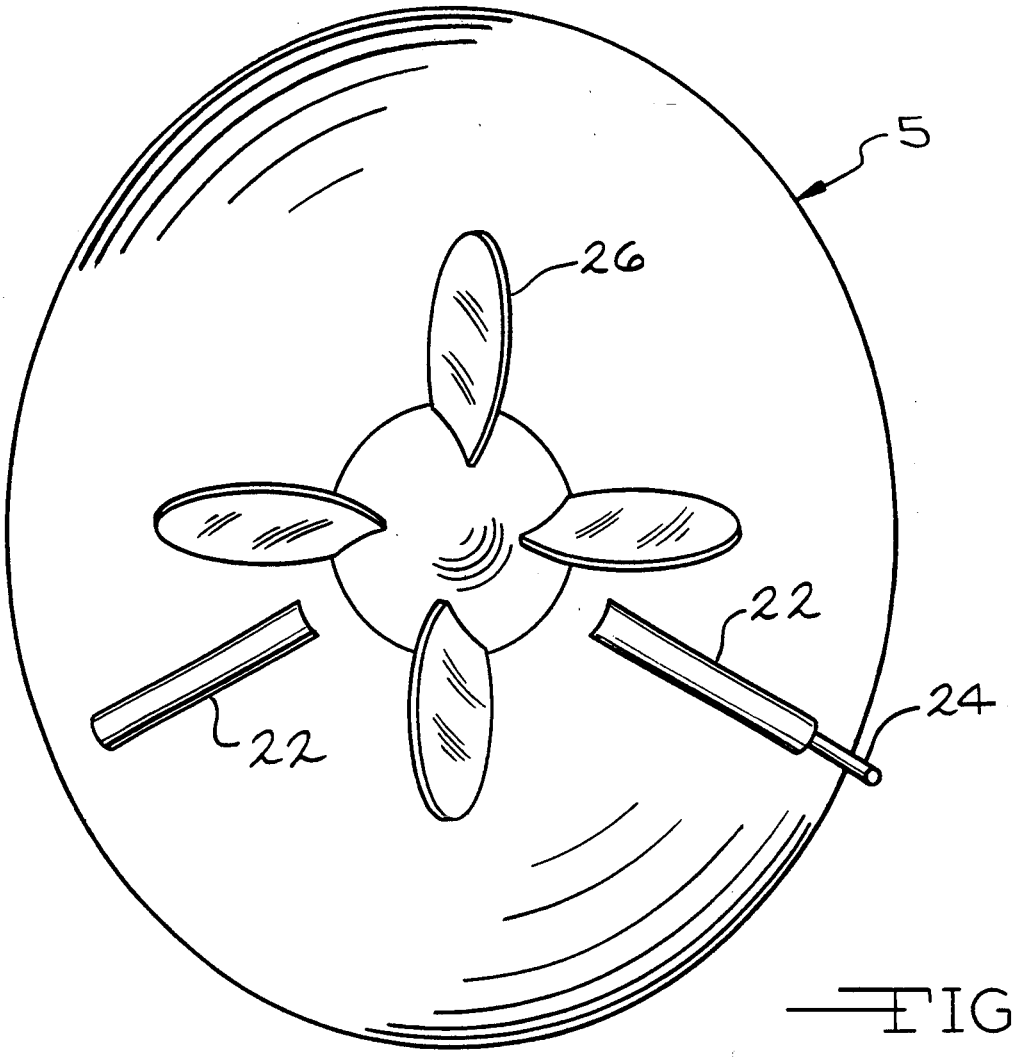
FIG. 4 is a rear elevational view, similar to that of FIG. 2 wherein the exiting launch tube is directed aft.
Figure 5:
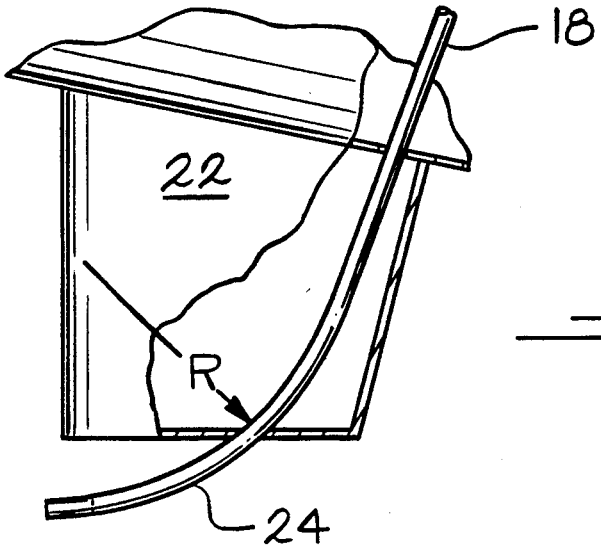
FIG. 5 is a partial view of a submarine dihedral fin, similar to that of FIG. 1 wherein the exiting launch tube is directed aft.

Referring now to FIG. 1, a schematic illustration of the principal elements of the present invention is shown as may be embodied in a typical submarine type vessel 5. A primary launch tube 12 extends through a vessel's pressure hull 10. Launch tube 12 has a breech chamber 14 positioned within pressure hull 10. A discharge end 16 of primary launch tube 12 is located external to the pressure hull 10. Extending from discharge end 16 of primary launch tube 12 is a secondary launch tube 18 navigating from primary launch tube 12 through the vessel's non-pressurized structure 20 and terminating at any desired or otherwise convenient location such as the vessel's dihedral stabilizer 22. By extending the secondary launch tube 18 through the dihedral stabilizer 22, a muzzle 24 of secondary launch tube 18 can be directed away from and clear of the vessel's structure 20 or propellers 26. As shown in FIG. 1 and FIG. 2, muzzle 24 of secondary launch tube 18 can be directed or aimed outward and away from the vessel's structure 20 or, as shown in FIG. 4 and FIG. 5, muzzle 24 of secondary launch tube 18 can be directed rearward from vessel's structure 20.

Integral with the primary launch tube 12, and inside the vessel's pressurized hull 10, is a breech chamber 14 having a breech door 39 suitable for loading therein an instrument package 30 and an associated tether line supply spool 32. Tether line supply spool 32 is mounted to breech door 39 allowing communication between supply spool 32 and instrument package 30. Hydraulically communicating with breech chamber 14, is the discharge port of a rotary pump 34 for hydraulically pressurizing breech chamber 14 with seawater. The suction port of rotary pump 34 hydraulically communicates with a seawater intake 28 extending through the vessel's pressurized hull 10. Intake valve 36 is located inside the vessel's pressure hull 10 between the suction port of pump 34 and the seawater intake 28 thereby permitting the suction port of pump 34 to be selectively opened or closed with respect to seawater intake 28 as desired. Similarly exit valve 38 is located, within the vessel's pressure hull 10, between breech chamber 14 and discharge end 16 of primary launch tube 12. Intake valve 36 and exit valve 38 can be ball valves, but are not limited to this mechanism.

Turning now to FIG. 1 the elements and operation of the present invention will be further discussed. An instrument package 30, is shown loaded in breech chamber 14. Instrument package 30 is inserted in breech chamber 14 between pump 34 discharge port and exit valve 38 via breech door 39. A tether line 40 (see FIG. 3), wound upon supply spool 32, is attached to the aft end of instrument package 30. When loading instrument package 30 in breech chamber 14, or at any time breech door 39 is to be opened, intake valve 36 and exit valve 38 are closed thereby preventing the flow of seawater into breech chamber 14 and pressurized hull 10.

After loading instrument package 30, breech door 39 is closed and valves 36 and 38 are opened to allow breech chamber 14 to fill with seawater and prime pump 34. Pump 34 is then energized thereby applying fluid pressure to the rear of instrument package 30 thus causing instrument package 30 to exit breech chamber 14, pass through exit valve 38 and primary launch tube 12 and enter secondary launch tube 18. As the instrument package 30 travels through the launch tube system, tether line 40 unwinds from spool 32. Thus instrument package 30 maintains a "hard wire" communication link with the launching vessel.

Figure 3:
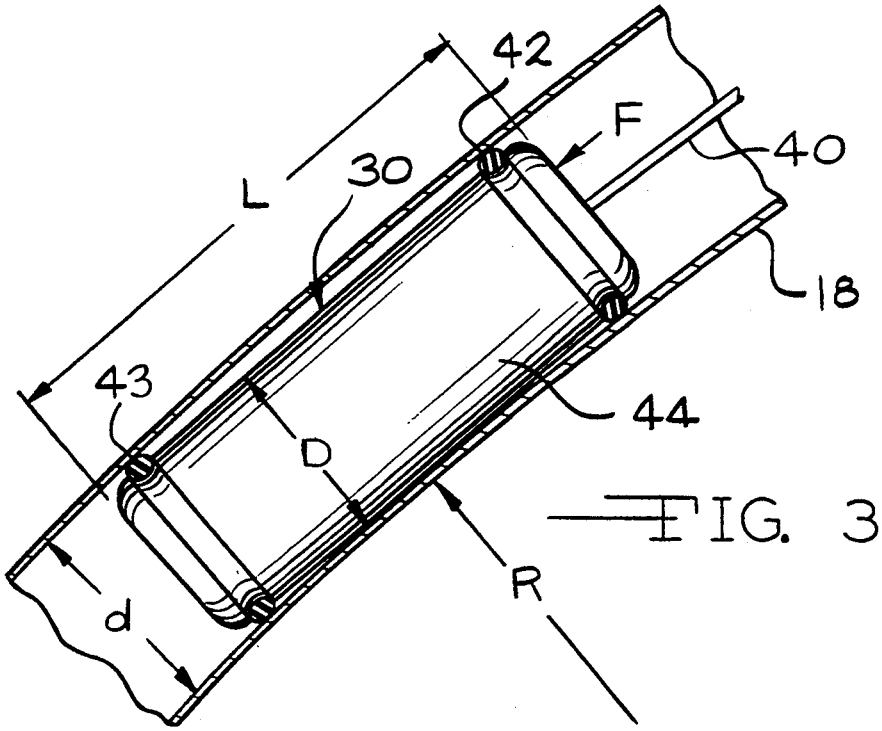
FIG. 3 is an enlarged view of the instrument package passing through the launch tube as indicated in FIG. 1.

Referring now to FIG. 3, it is observed that instrument package 30 generally comprises a cylindrical container 44 having an outside diameter D less than the inside diameter d of launch tube 18. Seals 42 and 43 of an 0-ring type, or simple bearing rings of low friction material, are provided at each end of cylinder 44 as illustrated. Seal 42 resists blow-by of the pressurized seawater, supplied by pump 34, thereby applying the propulsive force F upon the upstream side of instrument package 30. Similarly seal 43 resists passage thereof of the column of seawater ahead of the instrument package 30 thereby causing expulsion of that portion of seawater from muzzle end 24 of launch tube 18 as instrument package 30 advances therethrough.

As will be appreciated by viewing FIG. 3, the length L of cylinder 44 and the diametric difference between outside diameter D of cylinder 44 and the inside diameter d of launch tube 18 are interdependent upon one another and largely a function of the minimum radius of curvature R of secondary launch tube 18. For a given value of R, the length L of instrument package 30 must decrease as the outside diameter D of cylinder 44 increases so as to maintain clearance between the outside surface of cylinder 44 and the inside surface of launch tube 18 as instrument package 30 navigates the radius R. Because of the relatively long launch tube 18, instrument package 30 can be launched with a relatively low constant pump pressure but nevertheless achieve a desired high exit velocity from muzzle 24. This feature reduces the acoustic pressure impulse of launch more effectively than a system using a relatively short launch tube because of the relatively high accelerations required in a short launch tube to achieve the desired exit velocities. To better understand the advantage of using a long launch tube over a short tube consider the following where:

A = The acceleration of the instrument package 30 through launch tube 18.

C = Constant

F = The net hydraulic force applied to the rear of the instrument package 30 by pump 34.

m = The mass of instrument package 30.

t = Time

V = The instantaneous velocity of instrument package 30 at any given time t.

Ignoring Bernoulli type fluid losses we have:

$$F = mA$$

where: $A = dV/dt$

Therefore:

$$mdV/dt$$

and:

$$Fdt = mdV = C$$

$$F = C/dt$$

Thus if $mdV$ = constant, the force F required to achieve exit velocity is inversely proportional to the time required for launch.

By way of example:

1) if $mdV = 100$, $dt = 1$ $F = 100/1 = 100$ 2) if $mdV=100$, $dt=10$ $F=100/10=10$

Thus by the above example it is clearly understood that by the present invention a long and relatively slowly accelerating launch of the instrument package 30 can be realized thereby reducing the acoustic pressure impulse generated at the mouth of secondary launch tube 18.

For a given launch tube diameter d, the requisite capacity of pump 34 is a function of total launch tube length, elapsed time for launch, and the desired exit velocity of instrument package 30 from muzzle 24. Further it will be appreciated that as instrument package 30 velocity increases during its advance through secondary launch tube 18, the output flow rate of pump 34 must necessarily increase as a function of launch time so as to maintain a constant fluid pressure and thereby force F upon the rear surface of instrument package 30. Thus pump 34 must be sized to provide the necessary pressure and flow rate. Although the preferred embodiment disclosed above is directed toward a submarine application, the apparatus can be readily adapted for use on any type of vessel.

In light of the above, it is therefore understood that within the scope of the appended claims, the invention may be practiced otherwise than as specifically described.

What is claimed is:

1. A launch apparatus for a waterborne vessel comprising:

a launch tube extending through the hull of said vessel, said launch tube having a muzzle end exposed to environmental fluid external to said vessel's hull and a loading end internal to said vessel's hull;

an instrument package capable of sealing against the interior surface of said launch tube, said instrument package having a sliding fit through said launch tube to allow transportation of said instrument package through said launch tube;

a first valve joined to and in hydraulic communication with said loading end of said launch tube to allow selective interruption of the flow of fluid from said launch tube muzzle end while allowing transmission of said instrument package therethrough;

a breech valve means in communication with said first valve, said breech valve means allowing loading of said instrument package for launch from within said vessel's hull;

a hydraulic pump having a suction port and an output port in hydraulic communication with said breech valve means to allow a flow of pressurized fluid to be supplied to said breech valve means behind said instrument package to effect a launch of said instrument package; and a second valve in hydraulic communication with said environmental fluid and said hydraulic pump suction port to allow selective interruption of the flow of fluid to said suction port of said hydraulic pump.

2. The apparatus according to claim 1 wherein:

said launch tube extends through the hull of said vessel and is curved axially to allow transportation of said instrument package to a desired location on the exterior of the hull of said vessel; and said hydraulic pump provides a flow of fluid allowing substantially constant acceleration of said instrument package while said instrument package is travelling through said launch tube.

3. The apparatus according to claim 2 wherein said vessel is a submarine.

4. A launch apparatus for a waterborne vessel comprising:

a launch tube extending through the hull of said vessel, said launch tube having a muzzle end exposed to environmental fluid external to said vessel's hull and a loading end internal to said vessel's hull;

an instrument package capable of sealing against the interior surface of said launch tube, said instrument package having a sliding fit through said launch tube to allow transportation of said instrument package through said launch tube;

a first valve joined to an in hydraulic communication with said loading end of said launch tube to allow selective interruption of the flow of fluid from said launch tube muzzle end while allowing transmission of said instrument package therethrough;

a breech valve means in communication with said first valve, said breech valve means allowing loading of said instrument package for launch from within said vessel's hull;

a hydraulic pump having a suction port and an output port in hydraulic communication with said breech valve means to allow a flow of pressurized fluid to be supplied to said breech valve means behind said instrument package to effect a launch to said instrument package;

a second valve in hydraulic communication with said environmental fluid and said hydraulic pump suction port to allow selective interruption of the flow of fluid to said suction port of said hydraulic pump; and a tether line storage means disposed on said breech valve means for storing a cache of tether line for attachment to said instrument package and deployment of said tether line on launch of said instrument package;

said launch tube extending through the hull of said vessel and curving to allow transportation of said instrument package to a desired location on the exterior of the hull of said vessel; and said hydraulic pump providing a flow of fluid allowing substantially constant acceleration of said instrument package while said instrument package travels through said launch tube.

5. The apparatus according to claim 4 wherein said tether line storage means comprises a spool upon which the cache of tether line is wound.

6. The apparatus according to claim 5 wherein said breech valve means comprises:

a breech chamber joined in communication with said launch tube breech end to allow for placement of said instrument package before launch; and a breech door affixed to said breech chamber to allow access to said breech chamber for loading of said instrument package.

7. A launch apparatus for a submerged submarine comprising:

a launch tube extending through the pressure hull of said submarine, said launch tube having a muzzle end external to said pressure hull and hydraulically communicating with the open sea, said launch tube further having a loading end internal to said pressure hull;

an instrument package capable of sealing against the interior surface of said launch tube, said instrument package having a sliding fit through said launch tube to allow transportation of said instrument package through said launch tube;

a first valve joined to and in hydraulic communication with said loading end of said launch tube to allow selective interruption of the flow of seawater from said launch tube muzzle end while allowing transmission of said instrument package through said valve;

a breech valve means in communication with said first valve, said breech valve means allowing loading of said instrument package for launch from within said submarine's pressure hull;

a hydraulic pump having a suction port and an output port in hydraulic communication with said breech valve means to allow a flow of pressurized seawater to be supplied to said breech valve means behind said instrument package to effect a launch of said instrument package; and second valve in hydraulic communication with said seawater and said hydraulic pump suction port to allow selective interruption of the flow of seawater to said suction port of said hydraulic pump.

8. The apparatus according to claim 7 wherein:

said launch tube extends through the external hull of said submarine and is curved axially to allow transportation of said instrument package to a desired location on the exterior hull of said submarine; and said hydraulic pump provides a flow of fluid allowing substantially constant acceleration of said instrument package while said instrument package is travelling through said launch tube.

9. The apparatus according to claim 8 further comprising an extension tube fluidly communicating with the muzzle of said launch tube, said extension tube being routed through the non-pressurized portion of said submarine.

10. A launch apparatus for a submerged submarine comprising:

a launch tube extending through the pressure hull of said submarine, said launch tube having a muzzle end external to said pressure hull and hydraulically communicating with the open sea, said launch tube further having a loading end internal to said pressure hull;

an instrument package capable of sealing against the interior surface of said launch tube, said instrument package having a sliding fit through said launch tube to allow transportation of said instrument package through said launch tube;

a first valve joined to and in hydraulic communication with said loading end of said launch tube to allow selective interruption of the flow of seawater from said launch tube muzzle end while allowing transmission of said instrument package through said valve;

a breech valve means in communication with said first valve, said breech valve means allowing loading of said instrument package for launch from within said submarine's pressure hull;

a hydraulic pump having a suction port and an output port in hydraulic communication with said breech valve means to allow a flow of pressurized seawater to be supplied to said breech valve means behind said instrument package to effect a launch of said instrument package;

a second valve in hydraulic communication with said seawater and said hydraulic pump suction port to allow selective interruption of the flow of seawater to said suction port of said hydraulic pump; and a tether line storage means disposed on said breech valve means for storing a cache of tether line for attachment to said instrument package and deployment of said tether line on launch of said instrument package;

said launch tube extending through the external hull of said submarine and curving to allow transportation of said instrument package to a desired location on the exterior hull of said submarine;

said hydraulic pump providing a flow of fluid allowing substantially constant acceleration of said instrument package while said instrument package is travels through said launch tube.

11. The apparatus according to claim 10 wherein said tether line storage means comprises a spool upon which the cache of tether line is wound.

12. The apparatus according to claim 11 wherein said breech valve means comprises:

a breech chamber joined in communication with said launch tube breech end to allow for placement of said instrument package before launch; and a breech door affixed to said breech chamber to allow access to said breech chamber for loading of said instrument package.

13. A launch apparatus for a submerged submarine comprising:

a launch tube extending through the pressure hull of said submarine, said launch tube having a muzzle end external to said pressure hull and hydraulically communicating with the open sea, said launch tube further having a loading end internal to said pressure hull;

an instrument package capable of sealing against the interior surface of said launch tube, said instrument package having a sliding fit through said launch tube to allow transportation of said instrument package through said launch tube;

a first valve joined to and in hydraulic communication with said loading end of said launch tube to allow selective interruption of the flow of seawater from said launch tube muzzle end while allowing transmission of said instrument package through said valve;

a breech valve in communication with said first valve, said breech valve means allowing loading of said instrument package for launch from within submarine's pressure hull;

a hydraulic pump having a suction port and an output port in hydraulic communication with said breech valve means to allow a flow of pressurized seawater to be supplied to said breech valve means behind said instrument package to effect a launch of said instrument package;

a second valve in hydraulic communication with said seawater and said hydraulic pump suction port to allow selective interruption of the flow of seawater to said suction port of said hydraulic pump; and an extension tube fluidly communicating with the muzzle of said launch tube, said extension tube being routed through the non-pressurized portion of said submarine;

said launch tube extending through the external hull of said submarine and curving to allow transportation of said instrument package to a desired location on the exterior hull of said submarine;

said hydraulic pump providing a flow of fluid allowing substantially constant acceleration of said instrument package while said instrument package is travels through said launch tube;

said extension tube exiting said submarine through a dihedral stabilizer of said submarine.

14. The apparatus according to claim 13 wherein the muzzle end of said extension tube is directed aft of said submarine.

* * * * *